US011617457B2

(12) United States Patent
Rose et al.

(10) Patent No.: US 11,617,457 B2
(45) Date of Patent: Apr. 4, 2023

(54) MODULAR COUNTERTOP SHIELD

(71) Applicant: Extang Corporation, Ann Arbor, MI (US)

(72) Inventors: Brent Lorenz Rose, Jefferson, GA (US); Dean Mettler, Sturgis, MI (US)

(73) Assignee: EXTANG CORPORATION, Ann Arbor, MI (US)

( * ) Notice: Subject to any disclaimer, the term of this patent is extended or adjusted under 35 U.S.C. 154(b) by 293 days.

(21) Appl. No.: 16/923,500

(22) Filed: Jul. 8, 2020

(65) Prior Publication Data

US 2022/0007856 A1 Jan. 13, 2022

(51) Int. Cl.
*A47F 10/06* (2006.01)
*E05G 7/00* (2006.01)

(52) U.S. Cl.
CPC ..... *A47F 10/06* (2013.01); *E05G 7/004* (2013.01); *A47F 2010/065* (2013.01)

(58) Field of Classification Search
CPC ..... A47B 2200/12; A47B 2200/0084; A47B 47/042; A47B 97/00; A47B 41/00; A47G 5/00; A47F 10/06; A47F 2010/065; E05G 7/004
See application file for complete search history.

(56) References Cited

U.S. PATENT DOCUMENTS 3,326,147 A * 6/1967 Toney ..... A47B 41/00 312/196
3,550,540 A * 12/1970 Harris ..... A47B 3/10 312/258
3,627,272 A * 12/1971 Friedberg ..... E04H 1/12 256/25
3,636,890 A * 1/1972 Huff ..... A47B 41/02 312/196
3,927,481 A * 12/1975 Safranek ..... A47G 5/00 434/432
4,838,525 A * 6/1989 Snow ..... E04H 15/003 256/26

(Continued)

FOREIGN PATENT DOCUMENTS

JP 3152493 U 8/2009

OTHER PUBLICATIONS

Canadian Office Action, CA Application No. 3,099,595 dated Dec. 3, 2021.

(Continued)

*Primary Examiner* — Patrick D Hawn
(74) *Attorney, Agent, or Firm* — The Dobrusin Law Firm, P.C.

(57) ABSTRACT

The present teachings generally relate to a countertop shield and kit therefor, the countertop shield includes: a center panel including at least one long edge; at least one short edge; and at least one first center panel attachment feature, located adjacent to the at least one long edge and at least one second center panel attachment feature located adjacent to the at least one short edge; and at least one side panel including at least one side panel attachment feature; wherein the at least one first or second center panel attachment feature is configured to engage the at least one side panel attachment feature, wherein the center panel, the at least one side panel, or both are adapted to stand upright on a surface.

7 Claims, 3 Drawing Sheets

(56) References Cited

U.S. PATENT DOCUMENTS 4,874,210 A * 10/1989 Carroll ..... A47F 5/0025 312/121
4,906,824 A * 3/1990 Carroll ..... G07G 1/0018 312/211
4,926,609 A * 5/1990 Arico ..... G09F 15/0006 160/135
4,928,465 A * 5/1990 Del Castillo Von Haucke ..... E04B 2/7437 52/239
4,981,152 A * 1/1991 Laurent ..... E04H 15/003 135/900
5,611,384 A * 3/1997 Carter ..... G09F 15/0068 52/282.1
5,702,011 A * 12/1997 Carroll ..... A47B 87/00 211/186
6,293,328 B1 * 9/2001 Fremont ..... A47G 5/00 52/36.4
6,427,609 B1 * 8/2002 Grant ..... E04H 1/1255 108/60
D560,072 S * 1/2008 Willis ..... D6/332
7,690,158 B2 * 4/2010 Kelly ..... E04B 2/7429 52/794.1
7,823,309 B2 * 11/2010 Albenda ..... A47B 96/202 206/745
D691,402 S * 10/2013 Parker ..... A47B 97/00 D6/332
8,770,114 B2 * 7/2014 Kiskis ..... A47B 41/00 312/196
D760,318 S * 6/2016 Petrocelli ..... D20/43
10,610,011 B1 * 4/2020 Greenhill ..... A47B 23/042
11,160,376 B2 * 11/2021 Gass ..... A47B 97/00
11,375,808 B1 * 7/2022 Dawson ..... A47B 83/001
2011/0193453 A1 * 8/2011 Matus, Jr. ..... A47F 10/06 312/140.4
2019/0365101 A1 * 12/2019 Udagawa ..... A47B 97/00
2021/0212479 A1 * 7/2021 Atwal ..... A47F 10/06

OTHER PUBLICATIONS https://www.framedisplays.com/cocoshc66frp.html (accessed Jun. 12, 2020).
https://www.allplasticfabrication.com/product/hook-and-slot-sneeze-guards/ (accessed Jun. 12, 2020).
https://www.chinovdisplays.com/product/sectional-plexiglass-intubation-box-for-heath-care/ (accessed Jun. 12, 2020).
https://www.ebay.com/itm/254580688102 (accessed Jun. 12, 2020).

* cited by examiner

MODULAR COUNTERTOP SHIELD

FIELD

The present teachings generally relate to a protective shield and more particularly to a shield that can be placed on a countertop.

BACKGROUND

In many industries, it may be desirable for workers to be physically separated from other persons by protective shields to prevent liquids and/or airborne particulates from depositing on the worker's person or on surfaces of the worker's workstation. For example, protective shields may be utilized to prevent airborne droplets from reaching a user's face, thereby preventing any contagion contained therein from infecting the user. One particular type of protective shield is a countertop shield.

Countertop shields may be arranged so that the shield protects at least a portion of the worker's workstation. Some industries use shields with a single panel separating the worker from other persons. Other industries use shields with multiple panels affixed together. However, in both cases, the physical dimensions of the shields are typically fixed. As a result, options for arranging the shields are limited if perhaps workstations are rearranged or a worker's personal preference of the shield's arrangement is different than the personal preference of a worker from another shift who shares the same workspace. Furthermore, different industries require shields having different dimensions. For example, a convenience store may require shields that fit between areas of the counter occupied by merchandise displays. Additionally, manufacturing of shields to fit various demands regarding physical dimensions requires additional time and resources.

It would be desirable to provide a shield that is modular and that can be selectively arranged to conform to various physical dimensions. It would be desirable to provide a shield that is easily assembled for use and disassembled for transportation and/or storage. It would be desirable to provide a shield that is cost-effective to produce.

SUMMARY

The present disclosure relates to a protective shield, which may address at least some of the needs identified above, the shield comprising: a center panel including at least one long edge; at least one short edge; and at least one first center panel attachment feature, located adjacent to the at least one long edge and at least one second center panel attachment feature located adjacent to the at least one short edge; and at least one side panel including at least one side panel attachment feature; wherein the at least one first or second center panel attachment feature is configured to engage the at least one side panel attachment feature, wherein the center panel, the at least one side panel, or both are adapted to stand upright on a surface.

The present disclosure relates to a kit, which may address at least some of the needs identified above, the kit comprising: a center panel including at least one long edge; at least one short edge; and at least one first center panel attachment feature, located adjacent to the at least one long edge and at least one second center panel attachment feature located adjacent to the at least one short edge; and at least one side panel including at least one side panel attachment feature; wherein the at least one first or second center panel attachment feature is configured to engage the at least one side panel attachment feature.

DETAILED DESCRIPTION

Figure 1:
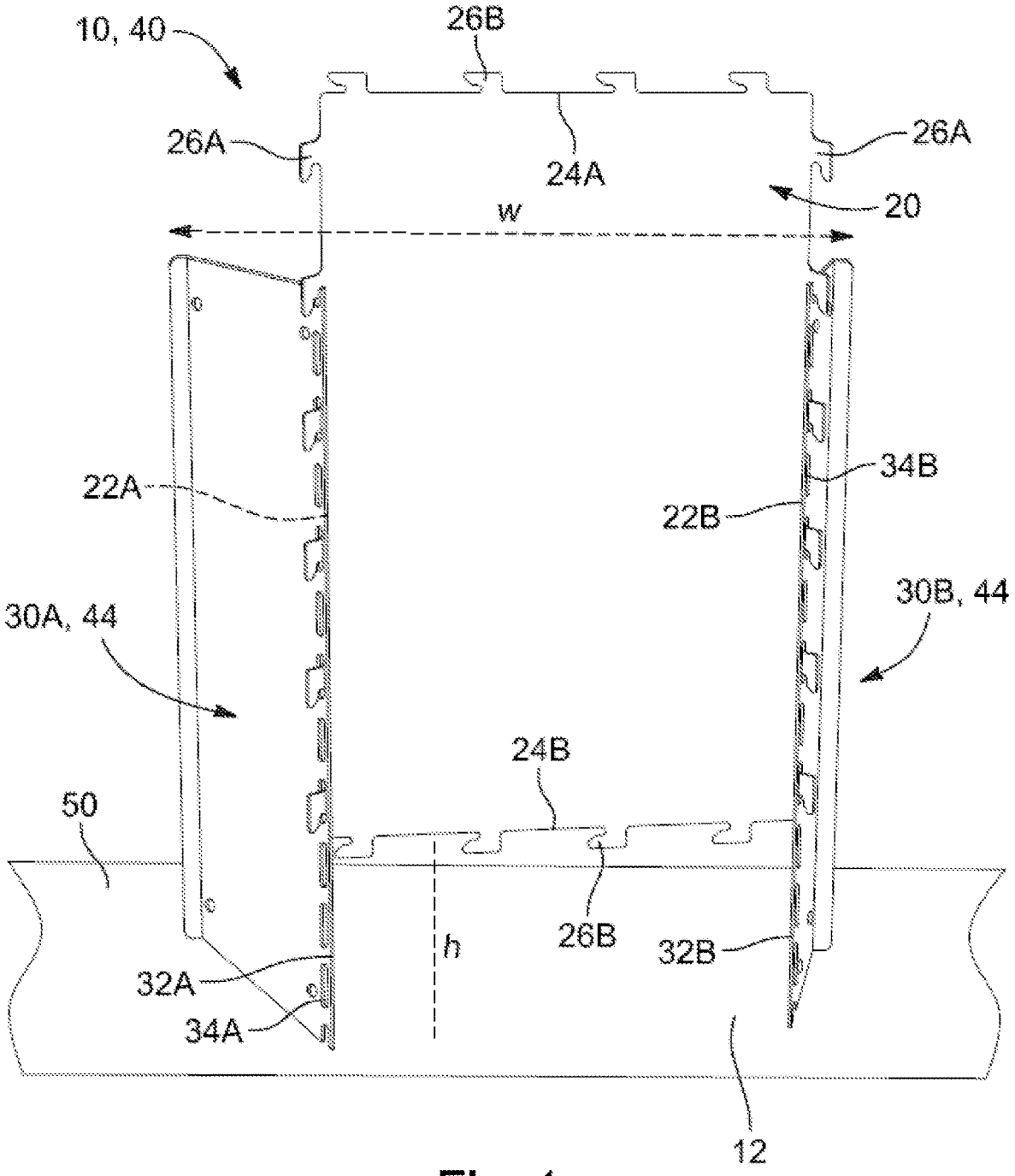
FIG. 1 illustrates a perspective view of a protective shield in a first configuration.

The present teachings meet one or more of the above needs by the improved protective shield and kit described herein. The explanations and illustrations presented herein are intended to acquaint others skilled in the art with the teachings, its principles, and its practical application. Those skilled in the art may adapt and apply the teachings in its numerous forms, as may be best suited to the requirements of a particular use. Accordingly, the specific embodiments of the present teachings as set forth are not intended as being exhaustive or limiting of the teachings. The scope of the teachings should, therefore, be determined not with reference to the description herein, but should instead be determined with reference to the appended claims, along with the full scope of equivalents to which such claims are entitled. The disclosures of all articles and references, including patent applications and publications, are incorporated by reference for all purposes. Other combinations are also possible as will be gleaned from the following claims, which are also hereby incorporated by reference into this written description.

The present application generally relates to a protective shield. The protective shield may be a countertop shield. The countertop shield may function to prevent airborne transmissions of liquids and/or particulates between persons. For example, the countertop shield may substantially or entirely block a contagion contained within droplets from reaching the user's face and potentially infecting the user with the contagion. The countertop shield may be used in various settings including but not limited to retail businesses, banks, corporate offices, manufacturing plants, restaurants, event spaces, medical facilities, government buildings, individual's homes, social gathering spaces, or any combination thereof. The countertop shield may be adapted to stand upright (i.e., generally perpendicular to a surface or at an angle to a surface) on a surface (e.g., a countertop of a retail business) or may be hung from a structure (e.g., a ceiling). More particularly, the at least one center panel, the at least one side panel, or both may be adapted to stand upright on a surface. The countertop shield may be freestanding.

The countertop shield or any portion thereof may comprise polymer and/or glass. The polymer and/or glass may be optically transparent, optically translucent, optically opaque, or any combination thereof. For example, the countertop shield may comprise a portion that is optically transparent and another portion that is optically translucent. Certain optical properties may be desired based on the setting in which the countertop shield is used. For example, a countertop shield used in a bank may comprise a lower portion that is optically translucent, so that documents on the teller's side are not readily visible, and an upper portion that is optically transparent, so that the teller and the client can engage in eye contact. The polymer may be acrylic (polymethlamethacrylate), polycarbonate, butyrate (cellulose acetate butyrate), PETG (glycol modified polyethylene terphthalate), the like, or any combination thereof. The glass may be silicate glass such as soda-lime glass, borosilicate glass, aluminosilicate glass, or any combination thereof. The glass may be annealed glass, heat-strengthened glass, tempered glass, or any combination thereof. The polymer and/or glass may be integrally colored, tinted (i.e., reduction of the transmission of light therethrough), or both. For example, tinted countertop shields may be desired for settings that are exposed to sunlight.

The countertop shield may be coated and/or laminated. The coating and/or lamination may function to impart enhanced properties (i.e., properties not inherent to the base material(s) the countertop shield is comprised of) to the countertop shield. The coating and/or lamination may impart water resistance, chemical resistance, shatter resistance, scratch resistance, color, tint, or any combination thereof.

The countertop shield may comprise at least one center panel. The at least one center panel may function to prevent airborne transmissions of liquid and/or particulates between persons. The at least one center panel may be generally planar, curved, bent along one or more axes, or any combination thereof. The bend may be at an angle of about 5° or more, 10° or more, 20° or more, 90° or less, 80° or less, or even 70° or less. The bend may function to provide stability to the countertop shield. The at least one center panel may comprise at least one edge. Preferably, the at least one center panel may comprise four edges although more or fewer edges are contemplated. The at least one center panel may have a profile that is triangular, square, or quadrilateral. For example, the at least one center panel may have a rectangular profile. The at least one center panel may comprise at least one long edge, at least one short edge, or both. The at least one edge may have a virtually any length. For example, the length may be about 30 cm or more, 50 cm or more, 3 m or less, or even 1 m or less. The at least one center panel may have any thickness. For example, the thickness may be about 0.1 mm or more, 1 mm or more, 1 cm or more, 6 cm or less, 4 cm or less, or even 2 cm or less.

The at least one center panel may comprise at least one first and/or second center panel attachment feature. The at least one first and/or second center panel attachment feature may function to engage with the at least one side panel and/or at least one side panel attachment feature. The at least one first and/or second center panel attachment feature may be integrally molded with the at least one center panel, affixed to the at least one center panel after the center panel is molded or formed, or both. The at least one first and/or second center panel attachment feature may be supported by the at least one side panel attachment feature; or at least one side panel attachment feature may be supported by the at least one first and/or second center panel attachment feature. The at least one first center panel attachment feature may be adjacent to the at least one long edge of the at least one center panel. The at least one second center panel attachment feature may be adjacent to the at least one short edge of the at least one center panel. As referred to herein, "adjacent to" may mean contacting, projecting from, or located 8 cm or less from an edge of the panel. The at least one center panel may be selectively engaged with the at least one side panel via the at least one first center panel attachment feature, adjacent to the at least one long edge, or via the at least one second center panel attachment feature, adjacent to the at least one short edge, so that a width of the countertop shield is adjustable. Any of the at least one first and/or second center panel attachment features may be modularly engageable with any of the at least one side panel attachment features so that a height of the at least one center panel, with respect to a surface upon or over which the countertop shield is supported, is adjustable. The at least one first and/or second center panel attachment feature may be located on a tab projecting from the at least one short edge and/or the at least one long edge of the at least one center panel. The at least one first and/or second center panel attachment feature may be located at generally uniform intervals (i.e., distance between adjacent attachment features), generally non-uniform intervals, or both. For example, a plurality of first center panel attachment features may be located at 5 cm intervals from each other.

The at least one first and/or second center panel attachment feature may be a hook, a slot, a hole or aperture, a pin, a sleeve, a snap, a clip, a twist tie, a magnet, a strap, a bracket, a hook and loop fastener, or any combination thereof. Preferably, the at least one first and/or second center panel attachment feature may be a hook. The hook may comprise a neck, projecting from the at least one center panel, and a depending portion, depending from the neck. The hook may extend through the slot and the at least one center panel may be shifted, with respect to the at least one side panel, so that the depending portion extends along the at least one side panel, thereby preventing axial movement of the hook with respect to the slot. The hook may project from the at least one long edge and/or the at least one short edge of the center panel. The hook may extend generally co-planar with the center panel or at an angle from a plane of the center panel. Hooks located on opposing long edges and/or short edges of the center panel may depend in the same direction or opposing directions. Preferably, the hooks located on opposing long edges and/or short edges of the center panel may depend in the same direction. The hook may be adapted to fit into a slot. In some aspects, the first and/or second center panel attachment feature may be a slot. The slot may be adapted to accept a hook. One or more dimensions of the slot may substantially correspond to one or more dimensions of the hook or may be larger than one or more dimensions of the hook. For example, the larger the width of the slot, with respect to the thickness of the hook, the more freedom of movement the hook may have within the slot and thereby, the at least one side panel may be shifted to flare inward and outward with respect to the at least one center panel.

The countertop shield may comprise at least one side panel. The at least one side panel may function to support the at least one center panel and/or prevent airborne transmissions of liquid and/or particulates between persons. The at least one side panel may engage with the at least one long edge and/or the at least one short edge of the at least one center panel. Two of the at least one side panel may support opposing edges of the at least one center panel (i.e., opposing long edges or opposing short edges). The at least one side panel may be generally planar, curved, bent along one or more axes, or any combination thereof. The bend may be at an angle of about 5° or more, 10° or more, 20° or more, 90° or less, 80° or less, or even 70° or less. The bend may function to provide stability to the countertop shield. The at least one side panel may comprise at least one edge. Preferably, the at least one side panel may comprise four edges although more or fewer edges are contemplated. The at least one side panel may have a profile that is triangular, square, or quadrilateral. For example, the at least one side panel may have a rectangular profile. The at least one side panel may have at least one long edge, at least one short edge, or both. The at least one long edge and the at least one short edge may provide for an adjustable depth of the countertop shield. The at least one edge may have a length of about 30 cm or more, 50 cm or more, 3 m or less, or even 1 m or less. The at least one side panel may have a thickness of about 0.1 mm or more, 1 mm or more, 1 cm or more, 6 cm or less, 4 cm or less, or even 2 cm or less.

The one or more side panels may comprise at least one side panel attachment feature. The at least one side panel attachment feature may function to engage with the center panel and/or the at least one first and/or second center panel attachment feature. The at least one side panel attachment feature may be integrally molded with the at least one center panel, affixed to the at least one center panel, or both. The at least one first and/or second center panel attachment feature may be supported by the at least one side panel attachment feature; or at least one side panel attachment feature may be supported by the at least one first and/or second center panel attachment feature. The at least one side panel attachment feature may be located adjacent to one or more edges of the at least one side panel, proximally on the at least one side panel, or anywhere therebetween. As referred to herein, "adjacent to" may mean contacting, projecting from, or located 8 cm or less from. The at least one side panel attachment feature may be located on a tab projecting from the at least one edge of the at least one side panel. The at least one side panel attachment feature may be located at generally uniform intervals (i.e., distance between adjacent attachment features), generally non-uniform intervals, or both. For example, a plurality of side panel attachment features may be located at 5 cm intervals from each other.

The at least one side panel attachment feature may be a hook, a slot, a fastener hole, a pin, a sleeve, a snap, a clip, a twist tie, a magnet, a strap, a bracket, hook and loop fastener, or any combination thereof. Preferably, the at least one side panel attachment feature is a slot. The slot may be adapted to accept a hook. One or more dimensions of the slot may substantially correspond to one or more dimensions of the hook or may be larger than one or more dimensions of the hook. For example, the larger the width of the slot, with respect to the thickness of the hook, the more freedom of movement the hook may have within the slot and thereby, the at least one side panel may be shifted to flare inward and outward with respect to the at least one center panel. In some aspects, the at least one side panel attachment feature may be a hook. The hook may comprise a neck, projecting from the at least one center panel, and a depending portion, depending from the neck. The hook may extend through the slot and the at least one center panel may be shifted, with respect to the at least one side panel, so that the depending portion extends along the at least one side panel, thereby preventing axial movement of the hook with respect to the slot. The hook may project from the at least one long edge and/or the at least one short edge of the center panel. The hook may extend generally co-planar with the center panel or at an angle from a plane of the center panel. Hooks located on opposing long edges and/or short edges of the center panel may depend in the same direction or opposing directions. Preferably, the hooks located on opposing long edges and/or short edges of the center panel may depend in the same direction. The hook may be adapted to fit into a slot.

The countertop shield may be arranged in one or more configurations. Thus, it may be understood that the countertop shield is modular and may be arranged in various ways. The countertop shield may be arranged in a first configuration (i.e., narrow configuration). In the first configuration, the at least one first center panel attachment feature, located adjacent to the at least one long edge, may engage the at least one side panel attachment feature so that the at least one short edge is suspended cantilever above a surface. The first configuration may provide for a width of the countertop shield that is substantially defined by the length of the at least one short edge of the at least one center panel. The countertop shield may be arranged in a second configuration (i.e., wide configuration). In the second configuration, the at least one first second center panel attachment feature, located adjacent to the at least one short edge, is configured to engage with the at least one side panel attachment feature so that the at least one long edge is suspended cantilever above a surface. The second configuration may provide for a width of the countertop shield that is substantially defined by the length of the at least one long edge of the at least one center panel. The countertop shield may be arranged in a third configuration (i.e., shallow configuration). In the third configuration, the at least one side panel attachment feature, located adjacent to at least one long edge of the at least one side panel, may engage the at least one first or second center panel attachment feature and the countertop shield may be supported on a surface by at least one short edge of the at least one side panel. The third configuration may provide for a depth of the countertop shield that is substantially defined by the length of the at least one short edge of the at least one side panel. The countertop shield may be arranged in a fourth configuration (i.e., deep configuration). In the fourth configuration, the at least one side panel attachment feature, located adjacent to a short edge of the at least one side panel, may engage the at least one first or second center panel attachment feature and the countertop shield may be supported on a surface by the at least one long edge of the at least one side panel. The fourth configuration may provide for a depth of the countertop shield that is substantially defined by the length of the at least one long edge of the at least one side panel. The first configuration or the second configuration may be simultaneously implemented with the third configuration or the fourth configuration. For example, the first configuration and the third configuration may be simultaneously implemented. It may also be understood that the third configuration and the fourth configuration may be simultaneously implemented where the countertop shield comprises two of the at least one side panel. In any of the first, second, third, and fourth configurations, the at least one center panel may be adjusted to various heights, with respect to a surface upon or over which the countertop shield is supported, via the modular engagement of the at least one first and/or second center panel attachment feature and the at least one side panel attachment feature.

The countertop shield may comprise at least one aperture. The at least one aperture may function to allow objects to be passed through the countertop shield. For example, a convenience store cashier may receive merchandise from a customer through the aperture in order to ring up the items and after consummation of a purchase, the cashier may pass the merchandise back to the customer through the aperture. The at least one aperture may be defined by the center panel and the at least one side panel when the center panel is engaged with the at least one side panel. The dimensions of the at least one aperture may be adjustable via the modular arrangement of the at least one center panel and the at least one side panel. For example, in the first configuration, the width of the aperture may be substantially defined by the length of the at least one short edge of the at least one center panel. As another example, the height of the aperture may be substantially defined by the height of the at least one center panel, with respect to a surface upon or over which the countertop shield is supported. The countertop shield may be modularly arranged so that the countertop shield is free of a window. For example, the at least one center panel may be supported by the at least one side panel so that the at least one center panel is substantially flush with the surface upon or over which the countertop shield is supported.

The at least one center panel, the at least one side panel, or both, may comprise one or more frames. The frame may function to provide strength to the at least one center panel, the at least one side panel, or both. The frame may comprise polymer, glass, metal, wood, or any combination thereof. The frame may be located around the entire perimeter of the at least one center panel, the at least one side panel, or both; or a portion thereof. The frame may be affixed to one or both opposing faces of the at least one center panel, the at least one side panel, or both.

FIG. 1 illustrates a perspective view of a protective or countertop shield 10 in a first configuration 40. The countertop shield 10 includes a center panel 20 supported by two side panels 30A, 30B. The two side panels 30A, 30B are in a third configuration 44. The countertop shield 10 is supported on a surface 50. In the first configuration 40, the countertop shield 10 has a smaller width w as compared to the second configuration 42, as shown in FIG. 2.

The center panel 20 includes two long edges 22A, 22B opposing each other and two short edges 24A, 24B opposing each other. The center panel 20 includes first center panel attachment features 26A (i.e., hooks) projecting from the two long edges 22A, 22B and second center panel attachment features 26B (i.e., hooks) projecting from the two short edges 24A, 24B. The first and second center panel attachment features 26A, 26B project co-planar with the center panel 20. The first center panel attachment features 26A projecting from the long edge 22A depend in the same direction as the first center panel attachment features 26A projecting from the long edge 22B. The second center panel attachment features 26B projecting from the short edge 24A depend in the same direction as the second center panel attachment features 26B projecting from the short edge 24B. The first and second center panel attachment features 26A, 26B project from the center panel 20 at uniform intervals on both of the two long edges 22A, 22B and both of the two short edges 24A, 24B.

The two side panels 30A, 30B include side panel attachment features 34A, 34B (i.e., slots) located adjacent to the edges 32A, 32B of the two side panels 30A, 30B. The side panel attachment features 34A, 34B are located at uniform intervals on both of the edges 32A, 32B of the two side panels 30A, 30B. The two side panels 30A, 30B are engaged with the center panel 20 via the first center panel attachment features 26A extending through the side panel attachment features 34A, 34B and thereby supporting the center panel 20 at a height h from the surface 50. The center panel 20, the two side panels 30A, 30B, and the surface 50 define an aperture 12.

Figure 2:
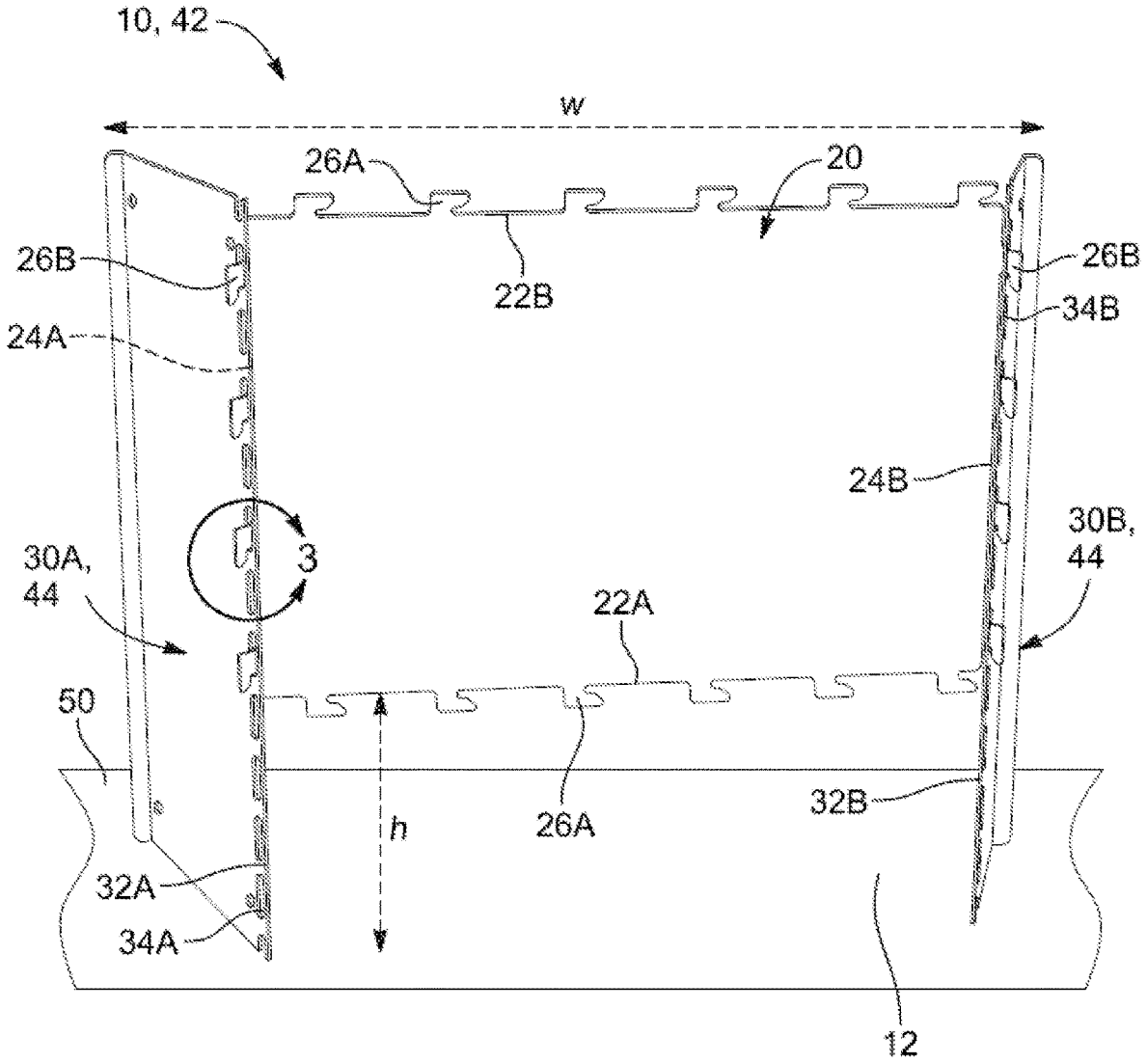
FIG. 2 illustrates a perspective view of a protective shield in a second configuration.

FIG. 2 illustrates a perspective view of a countertop shield 10 in a second configuration 42. The countertop shield 10 includes a center panel 20 supported by two side panels 30A, 30B. The two side panels 30A, 30B are in a third configuration 44. The countertop shield 10 is supported on a surface 50. In the second configuration 42, the countertop shield 10 has a larger width w as compared to the first configuration 40, as shown in FIG. 1.

The center panel 20 includes two long edges 22A, 22B opposing each other and two short edges 24A, 24B opposing each other. The center panel 20 includes first center panel attachment features 26A (i.e., hooks) projecting from the two long edges 22A, 22B and second center panel attachment features 26B (i.e., hooks) projecting from the two short edges 24A, 24B. The first and second center panel attachment features 26A, 26B project co-planar with the center panel 20. The first center panel attachment features 26A projecting from the long edge 22A depend in the same direction as the first center panel attachment features 26A projecting from the long edge 22B. The second center panel attachment features 26B projecting from the short edge 24A depend in the same direction as the second center panel attachment features 26B projecting from the short edge 24B. The first and second center panel attachment features 26A, 26B project from the center panel 20 at uniform intervals on both of the two long edges 22A, 22B and both of the two short edges 24A, 24B.

The two side panels 30A, 30B include side panel attachment features 34A, 34B (i.e., slots) located adjacent to the edges 32A, 32B of the two side panels 30A, 30B. The side panel attachment features 34A, 34B are located at uniform intervals on both of the edges 32A, 32B of the two side panels 30A, 30B. The two side panels 30A, 30B are engaged with the center panel 20 via the second center panel attachment features 26B extending through the side panel attachment features 34A, 34B and thereby supporting the center panel 20 at a height h from the surface 50. The center panel 20, the two side panels 30A, 30B, and the surface 50 define an aperture 12.

Figure 3:
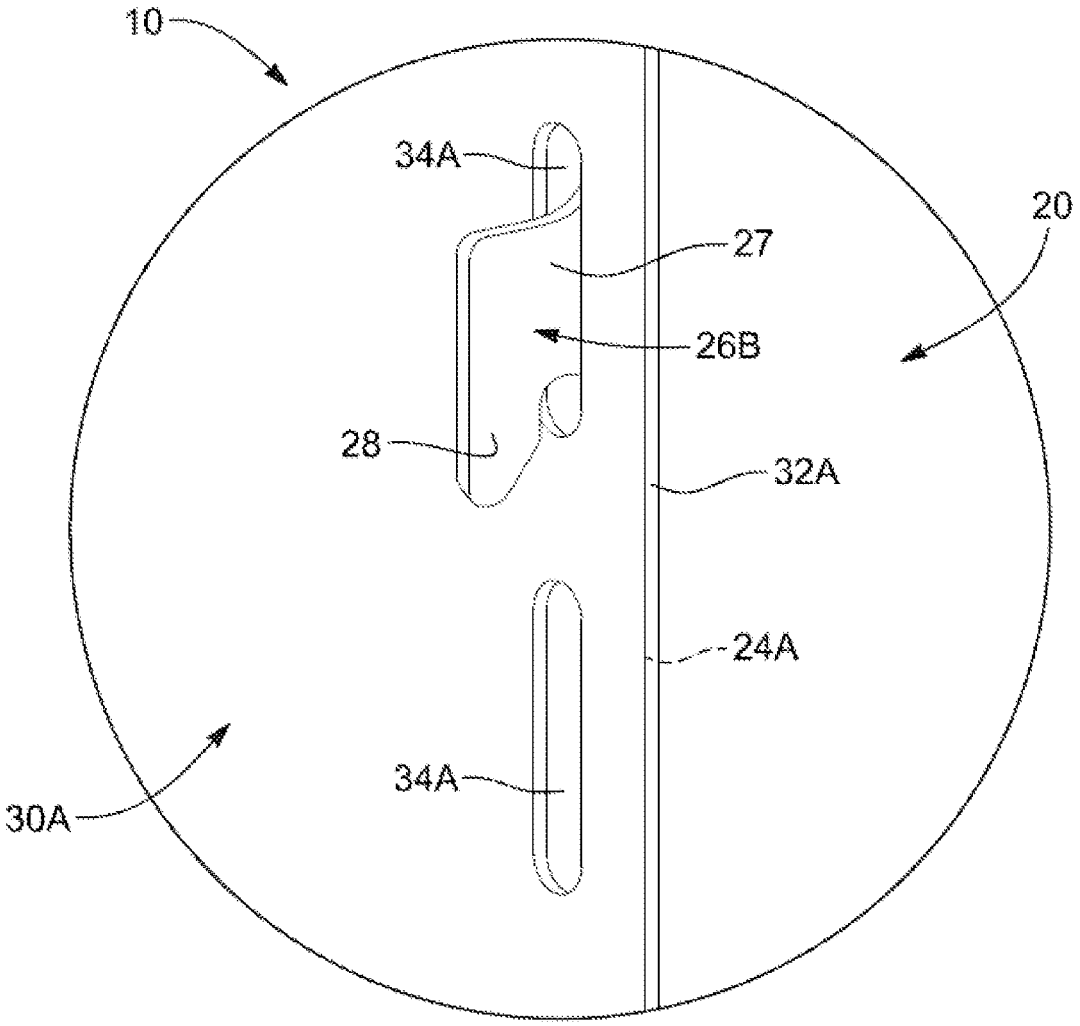
FIG. 3 illustrates a perspective view of a protective shield, as shown in FIG. 2.

FIG. 3 illustrates a perspective view of a countertop shield 10, as shown in FIG. 2. The countertop shield 10 comprises a center panel 20 and a side panel 30A. The center panel 20 includes second center panel attachment features 26B (i.e., hooks) projecting from the short edge 24A of the center panel 20, as shown in FIG. 2. The side panel 30A includes side panel attachment features 34A (i.e., slots) located adjacent to an edge 32A of the side panel 30A, as shown in FIG. 2.

The second center panel attachment feature 26B includes a neck 27 and a depending portion 28 projecting from the neck 27. The second center panel attachment features 26B extend through the side panel attachment features 34A and the neck 27 is supportable by the side panel 30A. When the neck 27 is supported by the side panel 30A, the depending portion 28 extends along the side panel 30A thereby preventing axial movement of the center panel 20 with respect to the side panel 30A and thereby providing a secure fitment between the center panel 20 and the side panel 30A.

Any numerical values recited in the above application include all values from the lower value to the upper value in increments of one unit provided that there is a separation of at least 2 units between any lower value and any higher value. These are only examples of what is specifically intended and all possible combinations of numerical values between the lowest value and the highest value enumerated are to be considered to be expressly stated in this application in a similar manner. Unless otherwise stated, all ranges include both endpoints and all numbers between the endpoints.

The terms "generally" or "substantially" to describe angular measurements may mean about +/−10° or less, about +/−5° or less, or even about +/−1° or less. The terms "generally" or "substantially" to describe angular measurements may mean about +/−0.01° or greater, about +/−0.1° or greater, or even about +/−0.5° or greater. The terms "generally" or "substantially" to describe linear measurements, percentages, or ratios may mean about +/−10% or less, about +/−5% or less, or even about +/−1% or less. The terms "generally" or "substantially" to describe linear measurements, percentages, or ratios may mean about +/−0.01% or greater, about +/−0.1% or greater, or even about +/−0.5% or greater.

The term "consisting essentially of" to describe a combination shall include the elements, ingredients, components, or steps identified, and such other elements ingredients, components or steps that do not materially affect the basic and novel characteristics of the combination. The use of the terms "comprising" or "including" to describe combinations of elements, ingredients, components, or steps herein also contemplates embodiments that consist essentially of the elements, ingredients, components, or steps.

Plural elements, ingredients, components, or steps can be provided by a single integrated element, ingredient, component, or step. Alternatively, a single integrated element, ingredient, component, or step might be divided into separate plural elements, ingredients, components, or steps. The disclosure of "a" or "one" to describe an element, ingredient, component, or step is not intended to foreclose additional elements, ingredients, components, or steps.

REFERENCE NUMERALS

10 Countertop shield
12 Aperture
w Width
20 Center panel
22 Long edge
24 Short edge
26A First center panel attachment feature (i.e., adjacent to long edge)
26B Second center panel attachment features (i.e., adjacent to short edge)
27 Neck
28 Depending portion
h Height
30 Side panel
32 Edge
34 Side panel attachment features
40 First configuration (i.e., narrow configuration)
42 Second configuration (i.e., wide configuration)
44 Third configuration (i.e., shallow configuration)
50 Surface

The invention claimed is:

1. A protective shield comprising:
a center panel, which is transparent, including:
a long edge;
a short edge; and
at least one first hook projecting from the long edge and at least one second hook projecting from the short edge; and
a side panel, which is transparent, including:
at least one slot located adjacent to at least one edge of the side panel;
wherein the at least one first hook or the at least one second hook engages the at least one slot to connect together the center panel and the side panel; and
wherein the center panel, the side panel, or both stand upright on a surface;
wherein the protective shield comprises an aperture defined by the center panel, the side panel, and the surface such that the aperture is a gap between the bottom of the center panel and the surface;
wherein a height of the aperture is adjustable by adjusting a position of the center panel vertically relative to the side panel;
wherein the at least one first hook and the at least one second hook comprise a first portion that extends in a first direction, which is generally perpendicular to the long edge and the short edge, respectively, of the center panel, and a second portion that extends in a second direction, which is generally perpendicular to the first direction;
wherein the second portion comprises a chamfer;
wherein the side panel includes a bend for providing stability;
wherein the bend is located adjacent to an edge of the side panel opposing the at least one edge adjacent to which the at least one slot is situated;
wherein the bend is at an angle of about 90° or less;
wherein the at least one edge of the side panel includes a long edge and a short edge; and
wherein the at least one slot includes at least one first slot located adjacent to the long edge of the side panel and at least one second slot located adjacent to the short edge of the side panel.

2. The protective shield of claim 1, wherein the center panel is supported by the side panel from the at least one first hook or the at least one second hook.

3. The protective shield of claim 2, wherein in a first configuration, the at least one first hook engages the at least one slot, such that the short edge is parallel to the surface.

4. The protective shield claim 3, wherein in a second configuration, the at least one second hook engages the at least one slot, such that the long edge is parallel to the surface.

5. The protective shield of claim 4, wherein the at least one first hook and/or the at least one second hook include, respectively, a plurality of first hooks and/or a plurality of second hooks located on the center panel at generally uniform intervals; and where the at least one slot includes a plurality of slots located on the side panel at generally uniform intervals.

6. A protective shield comprising: a center panel, which is transparent, including: a long edge; a short edge; and at least one first slot located adjacent to the at least one long edge and at least one second slot located adjacent to the short edge; and a side panel, which is transparent, including: at least one hook projecting from at least one edge of the side panel; wherein the at least one first slot or the at least one second slot engages the at least one hook to connect together the center panel and the side panel; wherein the center panel is supportable by the side panel from the at least one first slot or the at least one second slot; wherein an aperture is defined by the center panel, the side panel, and a surface upon which the center panel and side panel are situated; wherein a height of the aperture is adjustable by adjusting a position of the center panel vertically relative to the side panel; wherein the at least one hook comprises a first portion that extends in a first direction, which is generally perpendicular to the at least one edge of the side panel, and a second portion that extends in a second direction, which is generally perpendicular to the first direction; wherein the second portion comprises a chamfer; wherein the side panel includes a bend for providing stability; wherein the bend is located adjacent to an edge of the side panel opposing the at least one edge from which the at least one hook projects; wherein the bend is at an angle of about 90° or less; wherein the at least one edge of the side panel includes a long edge and a short edge; and wherein the at least one hook includes at least one first hook projecting from the long edge of the side panel and at least one second hook projecting from the short edge of the side panel.

7. An adjustable protective shield comprising a transparent center panel and a transparent side panel, the adjustable protective shield is configurable in a first configuration where the transparent center panel is connected to the transparent side panel so that a short edge of the transparent center panel is parallel to a surface on which the adjustable protective shield is placed, and the adjustable protective shield is configurable in a second configuration where the transparent center panel is connected to the transparent side panel so that a long edge of the transparent center panel is parallel to the surface forming a gap between the transparent center panel and the surface; wherein both of the long edge and the short edge comprise a hook; wherein the transparent side panel comprises a slot; wherein the hook of the long edge and the hook of the short edge comprise a first portion that extends in a first direction, which is generally perpendicular to the long edge and the short edge, respectively, of the center panel, and a second portion that extends in a second direction, which is generally perpendicular to the first direction; and wherein the second portion comprises a chamfer; wherein the transparent side panel includes a bend for providing stability; wherein the bend is located adjacent to an edge of the transparent side panel opposing an edge adjacent to which the slot is situated; wherein the bend is at an angle of about 90° or less; wherein the transparent side panel includes a long edge and a short edge; and wherein the slot is adjacent to the long edge of the transparent side panel and the transparent side panel comprises a second slot located adjacent to the short edge of the transparent side panel.

* * * * *